United States Patent [19]

Foster et al.

[11] 4,303,191

[45] Dec. 1, 1981

[54] HINGED-LID PACKET FOR CIGARETTES

[75] Inventors: Norman Foster, Dibden Purlieu; Raymond A. Elson, Chandlers Ford, both of England

[73] Assignee: British-American Tobacco Company Limited, London, England

[21] Appl. No.: 82,615

[22] Filed: Oct. 9, 1979

[30] Foreign Application Priority Data

Oct. 16, 1978 [GB] United Kingdom ..... 40714/78

[51] Int. Cl.[3] ..... B65D 5/66

[52] U.S. Cl. ..... 229/44 CB

[58] Field of Search ..... 229/44 CB

[56] References Cited

U.S. PATENT DOCUMENTS

| | | | |
|---|---|---|---|
| Re. 29,887 | 1/1979 | Fox et al. | 229/44 CB |
| 3,874,581 | 4/1975 | Fox et al. | 229/44 CB |
| 3,888,407 | 6/1975 | Davies | 229/44 CB |

FOREIGN PATENT DOCUMENTS

| | | | |
|---|---|---|---|
| 1159393 | 2/1958 | France | 229/44 CB |

*Primary Examiner*—Davis T. Moorhead

*Attorney, Agent, or Firm*—Kane, Dalsimer, Kane, Sullivan & Kurucz

[57] ABSTRACT

The invention discloses a hinged-lid packet for cigarettes formed from a one-piece blank and having a body comprising a front wall panel, a rear wall panel and side wall panels. A lid is hingedly secured to the rear wall panel and has a front panel and inner and outer side wall panels on each side. The outer side wall panels are adhered to the outer faces of the associated inner panels only over a portion thereof so that the two panels on each side lie in a face-to-face relationship to provide gripping means for gripping, when the lid is closed, upstanding portions flaps on frame side panels extending upwardly from the side wall to thereby hold the lid closed.

6 Claims, 3 Drawing Figures

HINGED-LID PACKET FOR CIGARETTES

This invention relates to hinged-lid packets, for example hinged-lid packets for packaging elongate objects such as cigarettes.

Hinged-lid packets for packaging elongate objects such as cigarettes have long been known and commonly comprise a deep rectilinear body and a lid hingedly attached to a rear wall of the body. It is known for the body and the lid to be formed from a single blank and for the lid to hinge about a crease provided in the blank.

It is also known for hinged-lid packets to be provided with an inner frame, formed from a separate blank, comprising an inner front panel and inner side panels at opposite ends of the inner front panel, the inner front panel extending upwardly of the top edge of a front panel of the body and the inner side panels extending upwardly of the upper edges of respective side walls of the body. Thus, when the lid is in a closed position the frame extends upwardly therewithin to provide resistance to inadvertent opening of the lid.

There are also known hinged-lid packets in which instead of having a separate inner frame, have front and side panels for extending within the lid when closed, which front and side panels form a frame integral with the blank from which the body and lid are formed. Such packets, one of which is described in U.K. Pat. specification No. 507,998, are commonly termed "one-piece hinged-lid packets".

In some one-piece hinged-lid packets the side walls of the integral frame are attached both to the front wall thereof and to respective side wall panels of the body part. A blank for a packet of this type is disclosed in U.K. Pat. specification No. 819,205. As is described in specification No. 819,205, the front and side walls of the frame are inwardly offset, dog-leg fashion, so as to be readily accommodated within the closed lid.

In other one-piece hinged-lid packets the side walls of the integral frame, although being attached to the front wall thereof, are not attached to side wall panels of the body part. Blanks for packets of this type are disclosed in U.K. Pat. specifications Nos. 819,204 and 1,431,173. Reference to these specifications shows that in each case there is a slit between the side walls of the frame and adjacent side wall panels of the body part.

Although the frame parts in both two-piece and one-piece hinged-lid packets serve to resist inadvertent opening of the lids, the interference between the front, upper corners of the frame parts with the associated lids does not always hold the lids in a fully closed position. Thus, it is sometimes the case that the lids tend to gape even when in a nominally fully closed position.

It is known, as reference to the above mentioned specifications shows, to provide the frame, whether integral or formed from a separate blank, with an ear at each end of the front panel, each ear extending in the plane of the front panel outwardly from the corner of the frame. It is intended that the ears should serve to contact respective inner side-wall faces of the lid so as to hold the lid in a fully closed position, thus preventing the above mentioned gaping. In the case of frames formed from a separate blank, the provision of ears has met with some success in holding the lids closed. Integral frames, however, are formed of less material than separate frames and possess less strength and rigidity. For this reason the provision of ears on integral frames has caused a problem in that the resultant lateral compression applied to the front walls of the frames has caused buckling at the lower corners of cut-outs provided in the front wall. The creases thereby occurring at these corners are unsightly and make the packets unattractive to the consumer.

The present invention provides a hinged-lid packet comprising a body and a lid hingedly attached to the body, said body comprising a front wall, a rear wall and side walls and said lid comprising a front wall and side walls, flap means of one of said body and said lid being receivable in gripping means of the other of said body and said lid, the gripping means comprising first and second sheet material members disposed in face-to-face relationship.

Preferably the first and second sheet material members of the gripping means are provided by inner and outer side wall panels at respective sides of the lid, and advantageously the flap means are provided by side walls of frame means of the packet.

Although the invention is primarily concerned with one-piece hinged-lid packets, it could find application in hinged-lid packets having a separate frame.

In order that the invention may be clearly understood and readily carried into effect, reference will now be made, by way of example, to the accompanying diagrammatic drawings, in which.

Figure 1:
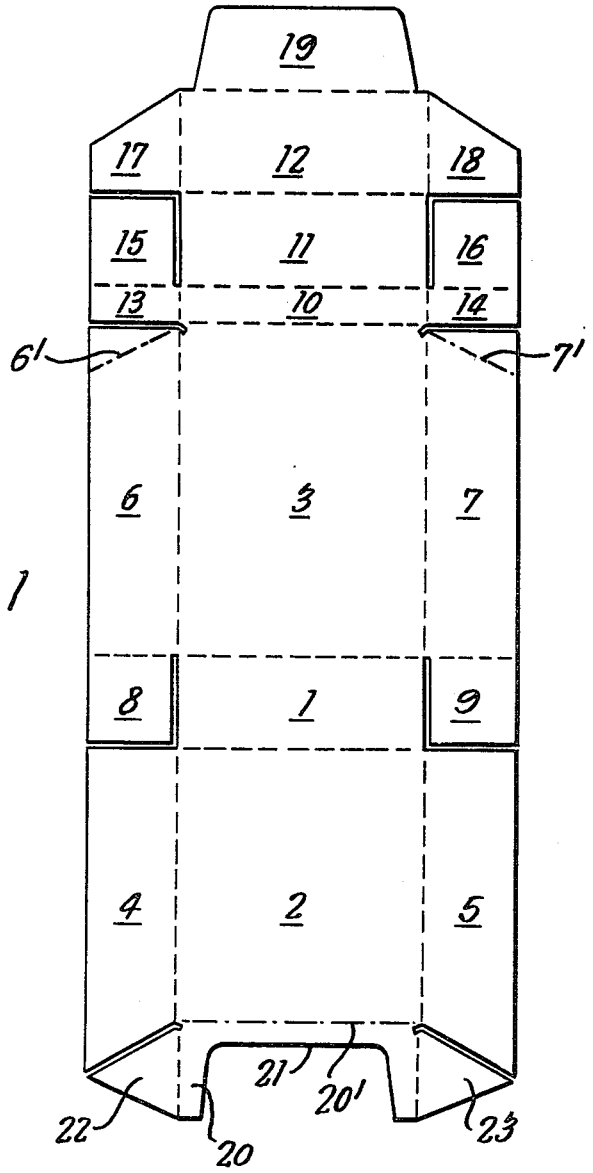
FIG. 1 shows a blank for a hinged-lid cigarette packet, broken lines indicating lines of creasing and chain lines indicating lines of offsetting.

Referring to FIG. 1, the blank there shown includes, for forming the body of the packet, a base panel 1 at respective longer sides of which are attached a front wall panel 2 and a rear wall panel 3. At respective opposite sides of the front wall panel 2 are attached outer side wall panels 4 and 5. Similarly, at opposite sides of the rear wall panel 3 there are attached inner side wall panels 6 and 7, to respective lower ends of which are attached tabs 8 and 9. As will be seen from FIG. 1, an upper triangular portion of each of the side panels 6 and 7 is offset along lines 6', 7' respectively. The off-setting is in dog-leg fashion inwardly of the plane of FIG. 1, it being assumed that FIG. 1 shows the face of the blank which in the erected packet is to the outer side of the packet. The triangular portions are offset by approximately the thickness of the sheet material of the blank.

The parts of the blank provided for forming the lid of the packet comprise a rear wall panel 10, attached at the upper end of the body panel 3, a top wall panel 11 attached to the edge of the panel 10 further from the panel 3, and a front wall panel 12 which is in turn attached to the panel 11. To respective side edges of the rear panel 10 are attached inner side wall panels 13 and 14, and attached at respective longer sides of the panels 13 and 14 are tabs 15 and 16 which, as can be seen in FIG. 1, are disposed at opposite ends of the panel 11. To respective side edges of the front panel 12 are attached outer side wall panels 17 and 18, and to the edge of the front panel 12 further from the panel 11 is attached a front-wall reinforcing panel 19.

To the edge of the body front wall panel 2 further from the base panel 1 there is attached a frame front panel 20 provided with a deep cut-out 21. The panel 20 is offset along a line 20' in a manner similar to that of the upper triangular portions of the panels 6 and 7. To the side edges of the panel 20 are attached frame side panels 22 and 23 of triangular shape, which panels are separated from the body side panels 4 and 5 respectively by slits. Each line of creasing between the panel 20 and the panels 22 and 23 may embody a cut extending over, for example, half the length of the line of creasing, the ends of the cut being spaced from the ends of the line of creasing.

Figure 2:
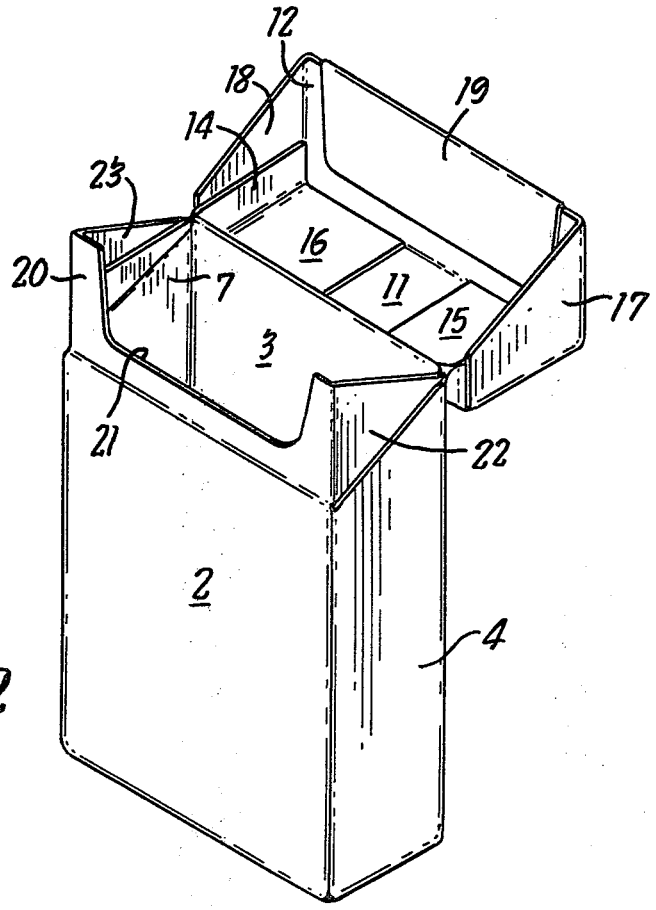
FIG. 2 is a perspective view, to a different scale, of the packet erected from the blank of FIG. 1, the lid of the packet being shown in an open position.

In erecting the packet shown in FIG. 2 from the blank of FIG. 1 the front and rear body wall panels 2 and 3 are folded perpendicularly to, and to the same side of the base panel 1. The outer side-wall panel 4 is folded to overlie, and is adhered to the inner side-wall panel 6. Similarly, the outer side-wall panel 5 is folded to overlie, and is adhered to the inner side wall panel 7. The tabs 8 and 9 overlie the base panel 1. The side panels 22 and 23 of the frames are received by and adhered to the respective upper offset triangular portions of the inner side-wall panels 6 and 7.

In the erected lid the reinforcing panel 19 is folded over and adhered in face-to-face relationship with the inner face of the front wall panel 12. The tabs 15 and 16 lie against the inner face of the top wall panel 11. The inner side-wall panels 13 and 14 extend perpendicularly to the tabs 15 and 16 respectively and the outer side wall panels 17 and 18 are adhered to the outer faces of the associated inner panels 13 and 14 only in those portions of the panels 13 and 14 which, with reference to FIG. 1, lie above a notional line drawn in each case from the inner lower corner to the outer upper corner of the panel. That is for panel 13 the triangular part in between said notional line and the crease lines between the panel 13 and panel 10 and tab 15 and, for panel 14, the triangular portion defined between the notional line and the crease lines between panel 14 and panel 10 and tab 16. Thus, when after the lid has been opened for removing a cigarette from the packet, the lid is once again closed, upper portions of the frame side walls 22 and 23 respectively, which portions extend above the upper edges of the inner side-wall panels 6 and 7, are received between the respective pairs of inner and outer side-wall panels 14, 18 and 13, 17 of the lid. These pairs of side-wall panels of the lid grip the upstanding portions of the frame side walls 22 and 23 and thus firmly hold the lid in its fully closed position.

The gripping of the side walls of the frame holds the lid fully closed without applying compressive force to the front panel 20 of the frame, and thus buckling at the lower corners of the cut-away 21 of the panel 20 is avoided.

Figure 3:
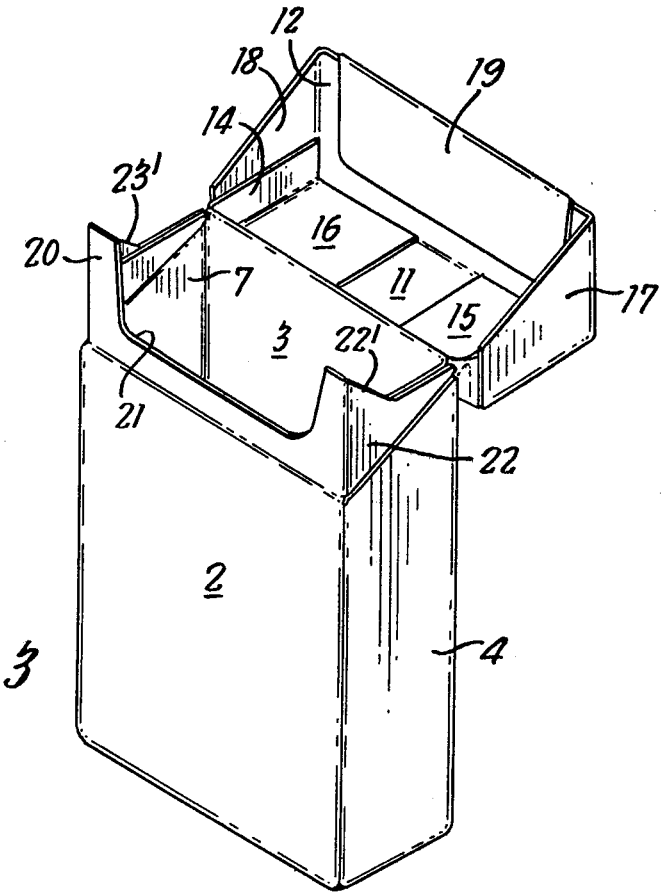
FIG. 3 is a view similar to that of FIG. 2 showing a modified form of packet.

Reference will now be made to FIG. 3, wherein similar reference numerals have been used for similar parts. The frame side panels 22 and 23 of the packet shown in FIG. 3 are each provided with an upper edge comprising a first portion which slopes downwardly from the upper edge of the frame front panel 20 and a second, horizontal portion. The horizontal portions of the upper edges of the frame side walls 22 and 23 extend in register with the respective upper edges of the panels 6 and 7. Thus, when the lid is in its closed position, triangular portions 22' and 23' of the walls 22 and 23 respectively, which portions 22' and 23' extend above the upper edges of the panels 6 and 7, are received between and gripped by the respective inner and outer side wall panels 14, 18 and 13, 17 of the lid, so as to firmly hold the lid in its fully closed position.

As will be appreciated, the gripping principle can be embodied other than as above described, for instance, instead of the frame side walls being gripped, it could be arranged that inner panels (not shown) of the lid front wall 12, 19 co-operate with the front wall 20 of the integral frame thereby to grip upper side portions of the wall 20. Alternatively, the side walls of the lid could each be provided with an extension arranged to be received between the inner and outer panels 4, 6 and 5, 7 of the side walls of the body.

We claim:

1. A hinged-lid packet comprising a body and a lid hingedly attached to the body, said body having a front wall 2, a rear wall 3 and side walls 4, 5, 6, 7, and said lid having a front wall 12, 19 and side walls 17, 18, flap means (22, 23) (22', 23') of one of said body and said lid, and gripping means (14, 18) (13, 17) in the other of said body and said lid for receiving said flap means (22, 23) (22', 23'), the gripping means comprising a portion of first 13, 14 and second 17, 18 sheet material members disposed in face-to-face unsecured relationship.

2. A packet as claimed in claim 1, wherein the first 13, 14 and second 17, 18 sheet material members of the gripping means are provided by inner and outer side wall panels of respective side walls of the lid.

3. A packet as claimed in claim 2 including frame means having frame side walls 22, 23, wherein the flap means are provided by said frame side walls of said frame means, the frame means includes a frame front panel 20 from the side edges of which said frame side walls 22, 23 extend, a crease line between each of the frame side walls and the frame front panel being slit over part of the length of the crease line spaced from the ends thereof.

4. A packet as claimed in claim 1 including a frame having a front panel extending upwardly from the body, the flap means being provided on said front panel of the frame, the gripping means comprising inner and outer panels of the front wall of the lid.

5. A packet as claimed in claim 1, wherein the flap means comprise portions of the side walls of the lid adapted to be received between inner and outer side wall panels or respective side walls of the body.

6. A packet as claimed in any one of claims 1, 2, 3, 4 and 5 formed from a one-piece blank.

* * * * *